US009540760B2

(12) United States Patent
Cai

(10) Patent No.: US 9,540,760 B2
(45) Date of Patent: Jan. 10, 2017

(54) ELECTROTHERMAL DEVICE FOR A STEAM IRON

(71) Applicant: Tsann Kuen (Zhangzhou) Enterprise Co., Ltd., Zhangzhou, Fujian (CN)

(72) Inventor: Rui-Feng Cai, Fujian (CN)

(73) Assignee: Tsann Kuen (Zhangzhou) Enterprise Co., Ltd., Zhanghou, Fujian (CN)

( * ) Notice: Subject to any disclaimer, the term of this patent is extended or adjusted under 35 U.S.C. 154(b) by 0 days.

(21) Appl. No.: 14/644,444

(22) Filed: Mar. 11, 2015

(65) Prior Publication Data

US 2015/0361611 A1 Dec. 17, 2015

(30) Foreign Application Priority Data

Jun. 12, 2014 (CN) ..... 2014 1 0260187
Nov. 11, 2014 (CN) ..... 2014 1 0631650

(51) Int. Cl.
*D06F 75/14* (2006.01)
*D06F 75/20* (2006.01)
*D06F 75/38* (2006.01)

(52) U.S. Cl.
CPC ..... *D06F 75/14* (2013.01); *D06F 75/20* (2013.01); *D06F 75/38* (2013.01)

(58) Field of Classification Search
CPC ..... D06F 75/00; D06F 75/18; D06F 75/20; D06F 75/24; D06F 75/36; D06F 75/38; D06F 75/14
See application file for complete search history.

(56) References Cited

U.S. PATENT DOCUMENTS 2,389,587 A * 11/1945 Appleman ..... D06F 75/24 219/254
2,483,579 A * 10/1949 Green ..... D06F 75/18 38/77.83
3,942,706 A * 3/1976 Schaeffer ..... D06F 75/38 228/164
4,196,340 A * 4/1980 Evans, Jr. ..... D06F 75/14 219/245

(Continued)

FOREIGN PATENT DOCUMENTS

WO 2007062986 A1 6/2007

OTHER PUBLICATIONS

EP Search Report in corresponding EP application No. 15157577.6-1710 dated Oct. 19, 2015 (5 pages).

*Primary Examiner* — Ismael Izaguirre
(74) *Attorney, Agent, or Firm* — Trop Pruner & Hu, P.C.

(57) ABSTRACT

An electrothermal device adapted for heating water into steam includes a heating plate including a heating base wall, an ironing plate mounted below the heating plate and including an ironing base wall and a spacing chamber, and a separating member. The heating base wall has a main perforation unit extending therethrough. The ironing base wall is spaced apart from the heating base wall, and has a secondary perforation unit communicating with the main perforation unit to allow the steam from the heating plate to pass through the ironing plate. The spacing chamber is formed between the heating base wall and the ironing base wall. The separating member is disposed on one of the heating base wall and the ironing base wall for separating the spacing chamber from the main perforation unit.

8 Claims, 4 Drawing Sheets

(56) References Cited

U.S. PATENT DOCUMENTS

| | | | | | |
|---|---|---|---|---|---|
| 4,837,952 | A * | 6/1989 | Hennuy | ..... | D06F 75/18<br>38/77.7 |
| 5,613,309 | A * | 3/1997 | Amsel | ..... | D06F 75/18<br>38/77.83 |
| 2013/0327759 | A1 * | 12/2013 | Otsuka | ..... | D06F 75/18<br>219/251 |

* cited by examiner

ELECTROTHERMAL DEVICE FOR A STEAM IRON

CROSS-REFERENCE TO RELATED APPLICATIONS

This application claims priority of Chinese Application No. 201410260187.9, filed on Jun. 12, 2014, and Chinese Application No. 201410631650.6, filed on Nov. 11, 2014.

FIELD

The disclosure relates to a steam iron, more particularly to an electrothermal device for a steam iron.

BACKGROUND

A conventional steam iron generally includes a housing, an electrothermal plate mounted below the housing, and a water reservoir mounted in the housing. The electrothermal plate includes a plate body that is formed with a plurality of through holes, and a heating member that is mounted in the plate body. The heating member can heat the plate body, so that water is heated and turns into steam via contact with the heated plate body when flowing from the water reservoir to the heated plate body. The steam then exits the steam iron via the through holes in the plate body and cooperates with the heated plate body to remove creases in clothing during the ironing process.

When in use, the plate body reaches a temperature ranging between 200° C. and 220° C., such heat being prone to damage the clothing. In view of this, some manufacturers of steam irons add a bottom plate beneath the plate body with a space therebetween. The bottom plate is formed with a plurality of outlet holes. When in use, the steam enters the space through the through holes and is subsequently discharged through the outlet holes. Damage to the clothing otherwise caused by the high temperature is reducible through the cooperation between the bottom plate with a lower temperature and the steam.

However, with this two-layer structure of the plate body and the bottom plate, contact with the bottom plate with the lower temperature may turn the steam within the space into water droplets, and remain on the bottom plate. This tends to cause the bottom plate to get rusty and shorten the service life of the conventional steam iron.

SUMMARY

Therefore, the object of the present disclosure is to provide an electrothermal device for a steam iron that can eliminate at least one of the aforesaid drawbacks of the prior art.

According to the present disclosure, there is provided an electrothermal device adapted for heating water into steam. The electrothermal device includes a heating plate, a heating member, an ironing plate and a separating member. The heating plate includes a heating base wall that has a bottom heating surface and that is formed with a main perforation unit extending through the bottom heating surface. The heating member is coupled to the heating plate for heating the heating plate to convert the water into the steam. The ironing plate is mounted below the heating plate, and includes an ironing base wall and a spacing chamber. The ironing base wall is spaced apart from the bottom heating surface of the heating base wall, and is formed with a secondary perforation unit communicating with the main perforation unit to allow the steam from the heating plate to pass through the ironing plate. The spacing chamber is formed between the bottom heating surface of the heating base wall and the ironing base wall. The separating member is disposed on one of the heating base wall and the ironing base wall for separating the spacing chamber from the main perforation unit so that the steam is prevented from entering the spacing chamber.

BRIEF DESCRIPTION OF THE DRAWINGS

Other features and advantages of the present disclosure will become apparent in the following detailed description of the embodiment with reference to the accompanying drawings, of which.

DETAILED DESCRIPTION

Figure 1:
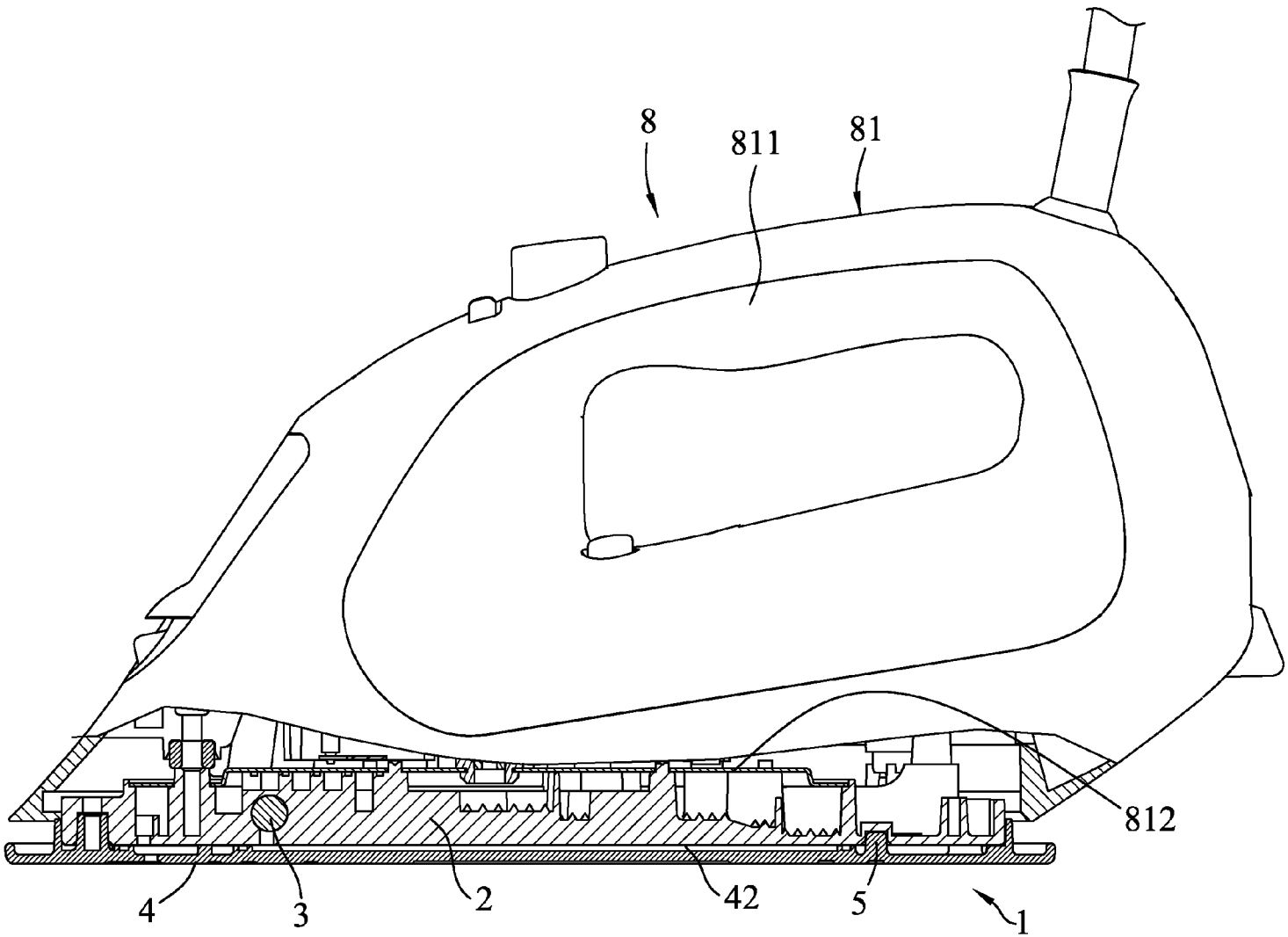
FIG. 1 is a perspective sectional view of an embodiment of an electrothermal device according to the present disclosure when coupled to a steam iron.
Figure 2:
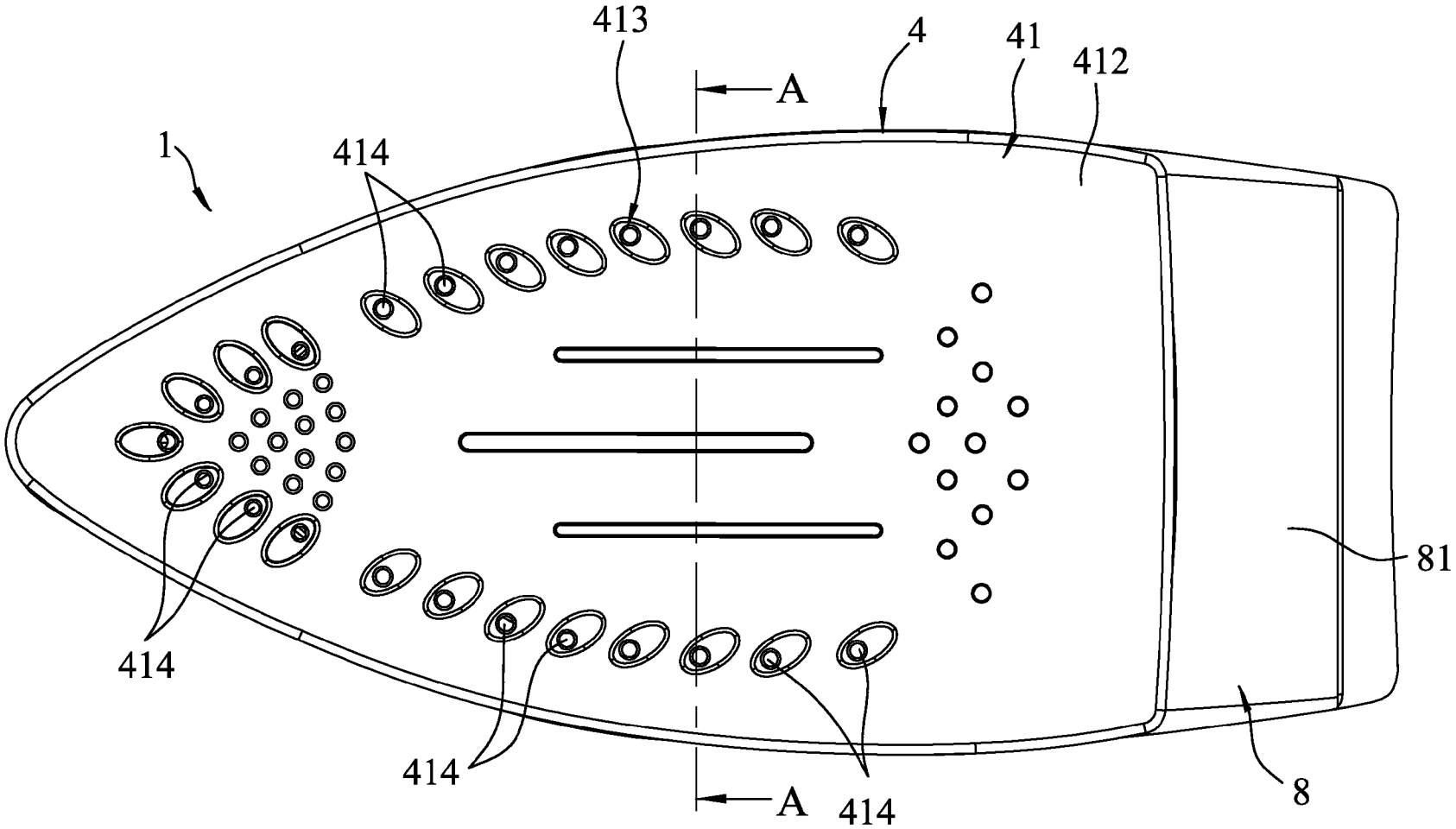
FIG. 2 is a bottom view of the embodiment.
Figure 3:
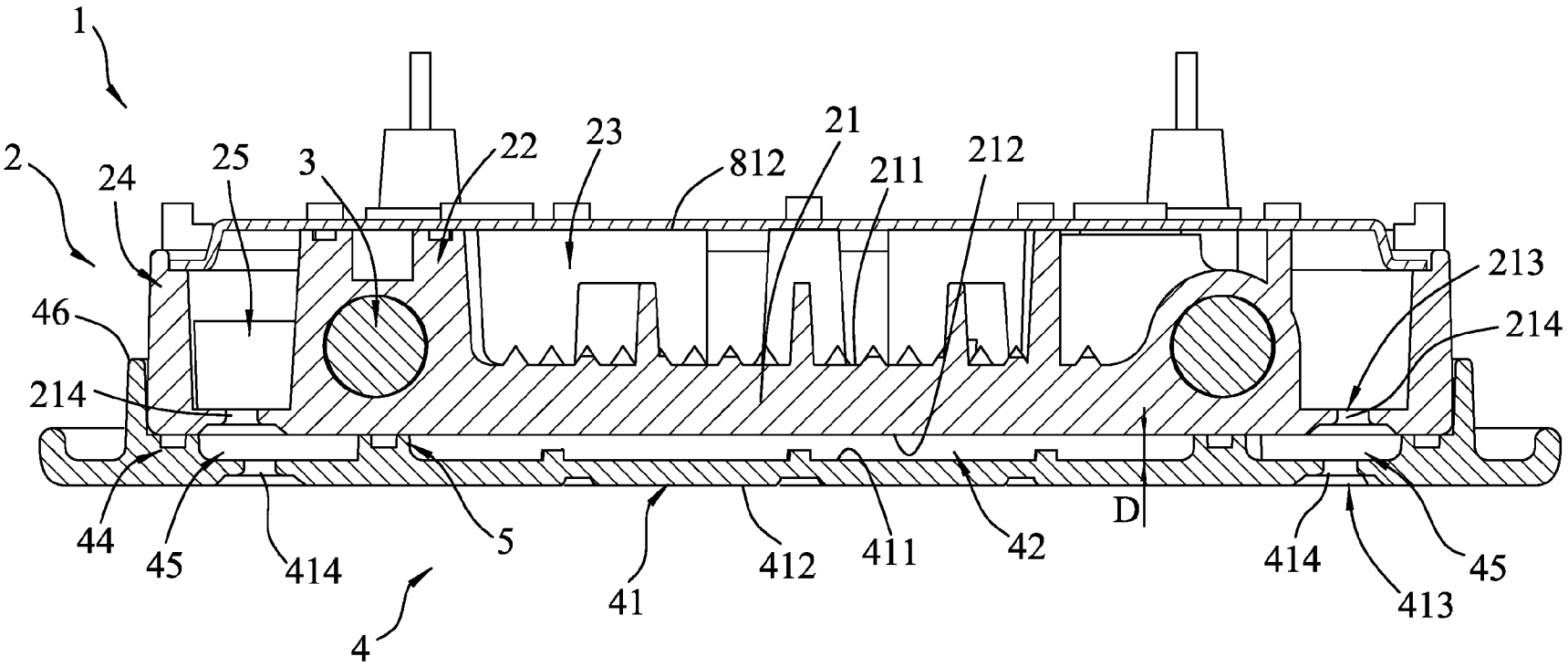
FIG. 3 is a sectional view of the embodiment taken along line A-A of FIG. 2.

Referring to FIGS. 1 to 3, an embodiment of an electrothermal device 1 according to the present disclosure is part of a steam iron 8. The steam iron 8 includes a housing 81 mounted on the electrothermal device 1, and a water reservoir (not shown) mounted in the housing 81. The housing 81 has a holdable body portion 811 adapted for a user to grasp thereon and carry the steam iron 8, and a bottom body portion 812 mounted below the holdable body portion 811. Water accommodated in the water reservoir is conveyable to the electrothermal device 1, and the electrothermal device 1 is adapted for heating the water into steam. The electrothermal device 1 includes a heating plate 2, a heating member 3, an ironing plate 4 and a separating member 5.

Figure 4:
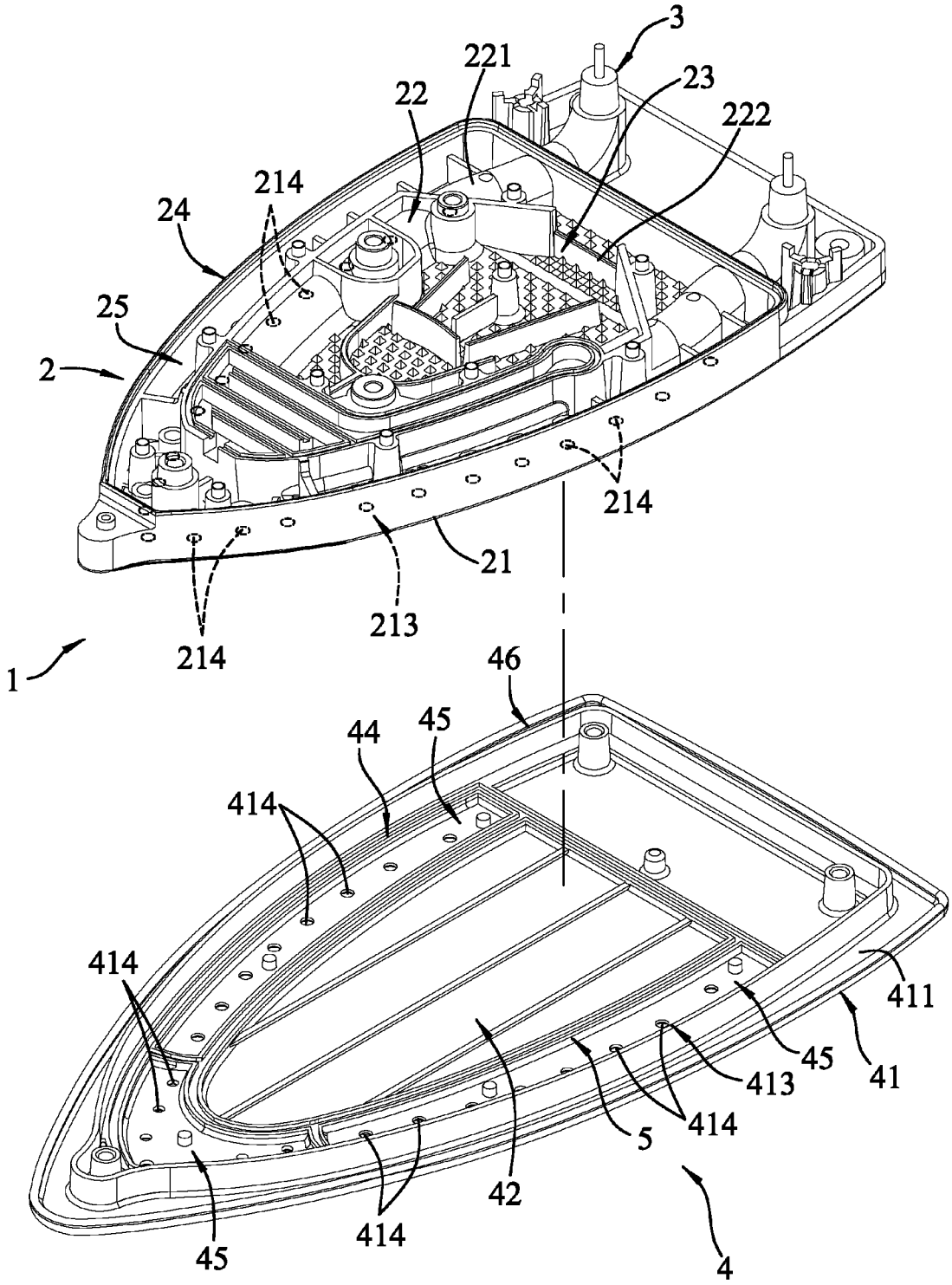
FIG. 4 is an exploded view for illustrating a heating plate and an ironing plate of the embodiment.

Referring to FIGS. 1, 3 and 4, the heating plate 2 is adapted to be mounted to the bottom body portion 812 of the housing 81, and includes a heating base wall 21. The heating member 3 is coupled to the heating plate 2 for heating the heating plate 2. The heating base wall 21 has a top heating surface 211 and a bottom heating surface 212 opposite to each other, and is formed with a main perforation unit 213. The main perforation unit 213 extends through the top and bottom heating surfaces 211, 212, and includes at least one through hole 214. In this embodiment, the main perforation unit 213 is exemplified to have a plurality of the through holes 214.

The heating plate 2 further includes an inner protruding wall 22, a water heating space 23, an outer protruding wall 24 and a steam flowing passage 25. The inner protruding wall 22 is provided on the top heating surface 211 and cooperates with the top heating surface 211 to define the water heating space 23 for heating water into steam. The inner protruding wall 22 has a heating section 221 and a connecting section 222. The heating section 221 corresponds in position and is proximate to and is connected to the heating member 3, and is substantially U-shaped. The connecting section 222 is distal from the heating member 3 and is connected to the heating section 221. The connecting section 222 and the heating section 221 cooperatively surround the water heating space 23. The outer protruding wall 24 is mounted on the top heating surface 211 and surrounds the inner protruding wall 22. The steam flowing passage 25 is formed between the inner protruding wall 22 and the outer protruding wall 24, and is in spatial communication with the main perforation unit 213. The water accommodated in the water reservoir is conveyable toward the water heating space 23. The steam generated by heating of the water will travel through the connecting section 222, the steam flowing passage 25, and the through holes 214 to reach the ironing plate 4.

Referring to FIGS. 2 to 4, the ironing plate 4 is mounted below the heating plate 2, and includes an ironing base wall 41 and a spacing chamber 42. The ironing base wall 41 is spaced apart from the bottom heating surface 212 of the heating base wall 21, has a top ironing surface 411 and a bottom ironing surface 412 opposite to each other, and is formed with a secondary perforation unit 413. The secondary perforation unit 413 includes at least one outlet hole 414. In this embodiment, the secondary perforation unit 413 includes a plurality of the outlet holes 414, each of which is registered with a corresponding one of the through holes 214 of the main perforation unit 213. The outlet holes 414 permit the steam coming from the through holes 214 to exit therefrom.

The top ironing surface 411 faces the bottom heating surface 212. The secondary perforation unit 413 extends through the top and bottom ironing surfaces 411, 412, and communicates with the main perforation unit 213 to allow the steam from the heating plate 2 to pass through the ironing plate 4.

The spacing chamber 42 is formed between the bottom heating surface 212 of the heating base wall 21 and the ironing base wall 41 to prevent the heating plate 2 from directly contacting the ironing plate 4 and to thereby reduce heat transferred to the ironing plate 4 from the heating plate 2.

The separating member 5 is disposed on one of the heating base wall 21 and the ironing base wall 41 for separating the spacing chamber 42 from the main perforation unit 213 so that the steam is prevented from entering the spacing chamber 42, and extends toward the other one of the heating base wall 21 and the ironing base wall 41. In this embodiment, the separating member 5 is formed on, for example, integrally, the top ironing surface 411, extends toward the bottom heating surface 212, and surrounds the spacing chamber 42. It should be noted that, the separating member 5 and the ironing plate 4 can be separately manufactured and then assembled/coupled together. Alternatively, the separating member 5 may be mounted below the heating plate 2 and extend from the bottom heating surface 212 toward the top ironing surface 411. Thus, the location and coupling method of the separating member 5 is not limited herein.

The ironing plate 4 further includes a surrounding wall 44 and at least one steam chamber 45. In this embodiment, the ironing plate 4 has a plurality of the steam chambers 45. The surrounding wall 44 extends from the ironing base wall 41 to the bottom heating surface 212 of the heating base wall 21, and surrounds the separating member 5 in a spaced-apart manner. Each of the steam chambers 45 is formed between the surrounding wall 44 and the separating member 5, and is in spatial communication with the main perforation unit 213 and the secondary perforation unit 413.

The separating member 5 also separates the spacing chamber 42 from the steam chambers 45 so that the spacing chamber 42 cannot communicate with the main perforation unit 213. In other words, steam passing through the steam chambers 45 will not enter the spacing chamber 42. In this embodiment, a plurality of fasteners (not shown) can be used to fasten the heating plate 2 with the ironing plate 4, and silicone can be used to connect the bottom heating surface 212 with the separating member 5 and an outer periphery of the surrounding wall 44.

In this embodiment, the ironing plate 4 further includes an extending wall 46 extending from the ironing base wall 41 and surrounding the bottom of the heating plate 2. Referring to FIGS. 1, 3 and 4, after the water in the water reservoir of the steam iron 8 is sent into the water heating space 23, the water is heated by the heating plate 2 and is turned into steam. The steam travels from the through holes 214 toward the steam chambers 45 of the ironing plate 4, and subsequently exits the steam iron 8 via the outlet holes 414. The discharged steam cooperates with the bottom ironing surface 412 to be used for ironing clothes.

The temperature of the heating base wall 21 ranges approximately between 180° C. and 220° C. after being heated by the heating member 3. Since the spacing chamber 42 is provided between the ironing plate 4 and the heating plate 2, the heat of the heating plate 2 will not be directly transmitted to the ironing plate 4. This is due to the air in the spacing chamber 42 isolating part of the heat emitted by the heating plate 2 so that temperature of the ironing plate 4 is maintained approximately between 100° C. and 150° C., preventing the ironing plate 4 from overheating. This way, the ironing plate 4 is less prone to damaging the clothes.

Moreover, due to the separation of the spacing chamber 42 from the steam chambers 45 by the separating member 5 so as to block communication between the spacing chamber 42 and the main perforation unit 213, the steam can directly pass through the secondary perforation unit 413 of the ironing plate 4 without making contact with the part of the ironing plate 4 surrounded by the separating member 5 and having a lower temperature, and thus, formation of water droplets in the spacing chamber 42 is prevented. In addition, since neither the steam nor the water droplets exist, let alone remain, in the spacing chamber 42, the part of the top ironing surface 411 of the ironing plate 4 within the spacing chamber 42 is effectively protected from rusting. Therefore, the purpose of increasing the service life of the ironing plate 4 is indeed served.

Furthermore, in order to firmly secure the heating plate 2 to the ironing plate 4, silicone paste may be provided between the top of the surrounding wall 44 and the bottom heating surface 212 of the heating base wall 21. Since the bottom of the heating plate 2 is surrounded by the extending wall 46, excess of the silicone paste can be prevented by the extending wall 46 from spreading out during the coupling of the assembly of the ironing plate 4 and the heating plate 2. The extending wall 46 also enhances the visual aesthetic quality of the electrothermal device 1.

It should be noted herein that, the ironing plate 4 may include a plurality of hole-surrounding walls (not shown) mounted on the top ironing surface 411 for respectively surrounding the outlet holes 414. Through isolation and guidance of the hole-surrounding walls, the steam passing through the through holes 214 will exit the outlet holes 414 directly, which further prevents the water droplets from being formed in the spacing chamber 42.

Moreover, as mentioned above, the main perforation unit 213 may include only one through hole 214, and the secondary perforation unit 413 may include only one outlet hole 414. The ironing plate 4 may include only one steam chamber 45 between the surrounding wall 44 and the separating member 5. Therefore, as long as the main perforation unit 213 and the secondary perforation unit 413 are configured to permit the steam to pass therethrough, and the steam chamber 45 communicates with the main and secondary perforation units 213, 413, the purpose of this disclosure is served and their numbers are not limited hereto.

In this embodiment, a distance (D) (see FIG. 3) between the top ironing surface 411 of the ironing plate 4 and the bottom heating surface 212 of the heating plate 2 ranges between 1 millimeter and 3 millimeters, so that the temperature of the ironing plate 4 may be kept between 100° C. and 150° C. From the experimental results shown in Table I below, the significance of the limitation on the distance (D) between the ironing surface 411 and the heating surface 212 are clearly illustrated.

In the following experiment from which the data of Table I are derived, the average temperature of the heating plate 2 is set at 185° C., and the temperature of the ironing plate 4 is measured in three modes, i.e., a dry mode, a low steam mode and a high steam mode for different distances (D), where the dry mode indicates absence of steam, the low steam mode indicates gasification of 10 g~25 g/min via the electrothermal device 1 of the steam iron 8, and the high steam mode indicates gasification of 25 g~35 g/min via the electrothermal device 1 of the steam iron 8. Furthermore, in the above three modes, "ON" indicates the lowest temperature of the ironing plate 4 when the electrothermal device 1 is activated and in stable operation, "OFF" indicates the highest temperature of the ironing plate 4 when the electrothermal device 1 is activated and in stable operation, and "AVE" indicates the average temperature between the "ON" and "OFF" temperatures.

TABLE I

| Distance | Temperature of the Ironing Plate (4) (° C.) | | | | | | | | |
|---|---|---|---|---|---|---|---|---|---|
| (D) | Dry Mode | | | Low Steam Mode | | | High Steam Mode | | |
| (mm) | ON | OFF | AVE | ON | OFF | AVE | ON | OFF | AVE |
| 0.5 | 163 | 180 | 171.5 | 145 | 162 | 153.5 | 125 | 144 | 134.5 |
| 1.0 | 146 | 153 | 149.5 | 135 | 145 | 140 | 132 | 140 | 136 |
| 2.0 | 138 | 144 | 141 | 125 | 130 | 127.5 | 120 | 125 | 122.5 |
| 3.0 | 135 | 140 | 137.5 | 115 | 121 | 118 | 110 | 115 | 112.5 |
| 4.0 | 108 | 112 | 110 | 101 | 105 | 103 | 98 | 101 | 99.5 |
| 5.0 | 108 | 113 | 110.5 | 98 | 102 | 100 | 95 | 98 | 96.5 |

From Table I, it is evident that when the distance (D) is smaller than 1 millimeter, the temperature of the ironing plate 4 exceeds 150° C. due to close proximity of the ironing plate 4 to the heating plate 2. Under this condition, the ironing plate 4 may overheat and damage the fibers of the clothes. On the other hand, when the distance (D) is greater than 3 millimeters, the temperature of the ironing plate 4 is under 100° C. and is unable to turn water into steam, let alone achieve an ironing effect. Thus, in this embodiment, the distance (D) between the top ironing surface 411 of the ironing plate 4 and the bottom heating surface 212 of the heating plate 2 is preferably designed to range from 1 millimeter to 3 millimeters, so that the temperature of the ironing plate 4 is kept between 100° C. and 150° C. and that a better ironing effect is ensured.

While the present disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. An electrothermal device adapted for heating water into steam, said electrothermal device comprising:

a heating plate including a heating base wall that has a bottom heating surface and that is formed with a main perforation unit extending through said bottom heating surface;

a heating member coupled to said heating plate for heating said heating plate to convert the water into the steam;

an ironing plate mounted below said heating plate, and including an ironing base wall that is spaced apart from said bottom heating surface of said heating base wall, and that is formed with a secondary perforation unit communicating with said main perforation unit to allow the steam from said heating plate to pass through said ironing plate, and a spacing chamber that is formed between said bottom heating surface of said heating base wall and said ironing base wall; and a separating member disposed on one of said heating base wall and said ironing base wall for separating said spacing chamber from said main perforation unit so that the steam is prevented from entering said spacing chamber;

wherein said ironing base wall has a top ironing surface facing said bottom heating surface of said heating base wall, and a bottom ironing surface opposite to said top ironing surface;

wherein said secondary perforation unit extends through said top and bottom ironing surfaces;

wherein said separating member is disposed on said top ironing surface, extends toward said bottom heating surface and surrounds said spacing chamber; and wherein said ironing plate further includes a surrounding wall extending from said ironing base wall to said bottom heating surface of said heating base wall, and surrounding said separating member in a spaced-apart manner, and at least one steam chamber formed between said surrounding wall and said separating member, said steam chamber being in spatial communication with said main perforation unit and said secondary perforation unit.

2. The electrothermal device as claimed in claim 1, wherein said heating base wall further has a top heating surface opposite to said bottom heating surface, said main perforation unit extending through said top and bottom heating surfaces, said heating plate further including an inner protruding wall that is provided on said top heating surface and that cooperates with said top heating surface to define a water heating space for heating the water into the steam.

3. The electrothermal device as claimed in claim 2, wherein said inner protruding wall has a heating section corresponding in position, disposed proximate and connected to said heating member, and a connecting section distal from said heating member and connected to said heating section, said connecting section and said heating section cooperatively surrounding said water heating space.

4. The electrothermal device as claimed in claim 2, wherein said heating plate further includes an outer protruding wall mounted on said top heating surface and surrounding said inner protruding wall, and a steam flowing passage formed between said inner protruding wall and said outer protruding wall and in spatial communication with said main perforation unit.

5. The electrothermal device as claimed in claim 1, wherein said main perforation unit includes at least one through hole, and said secondary perforation unit includes at least one outlet hole.

6. The electrothermal device as claimed in claim 5, wherein said at least one through hole includes a plurality of said through holes, and said at least one outlet hole includes a plurality of said outlet holes.

7. The electrothermal device as claimed in claim 1, wherein a distance between said ironing plate and said heating plate ranges between 1 millimeter and 3 millimeters.

8. The electrothermal device as claimed in claim 1, wherein said ironing plate further includes an extending wall extending from said ironing base wall and surrounding the bottom of said heating plate.

* * * * *